United States Patent [19]

Hart et al.

[11] Patent Number: 4,500,399

[45] Date of Patent: Feb. 19, 1985

[54] METHOD OF PRODUCING METAL-FILLED ORGANIC COATING

[75] Inventors: Robert G. Hart, Bethlehem; Herbert E. Townsend, Center Valley, both of Pa.

[73] Assignee: Bethlehem Steel Corporation, Bethlehem, Pa.

[21] Appl. No.: 534,010

[22] Filed: Sep. 20, 1983

[51] Int. Cl.[3] ..... C25D 13/20; C25D 13/04

[52] U.S. Cl. ..... 204/181 C; 204/181 T; 148/6.2; 148/6.27

[58] Field of Search ..... 204/181 T, 181 N, 181 C; 148/6.2, 6.27

[56] References Cited

U.S. PATENT DOCUMENTS

| | | | |
|---|---|---|---|
| 3,671,331 | 6/1972 | Malkin et al. | 204/181 T |
| 3,687,739 | 8/1972 | Kennedy et al. | 204/181 N |
| 4,220,675 | 9/1980 | Imazaki | 204/181 T |
| 4,346,143 | 8/1982 | Young, Jr. et al. | 204/181 C |

*Primary Examiner*—John F. Niebling
*Assistant Examiner*—B. J. Boggs, Jr.
*Attorney, Agent, or Firm*—William B. Noll

[57] ABSTRACT

This invention is directed to a coating method. In the preferred practice of this invention, the method includes the steps of selecting a ferrous substrate, such as steel sheet preferably containing a first coating having certain corrosion resistant and adhesion-promoting characteristics, applying thereto an outer coating of an organic resin containing a particulate metal selected from the group consisting of Al, Ni, Cr, Fe, Mn, Cu, Mo, Co, Ag, Au and alloys thereof, where the particle size of said metal or alloy is prefereably no more than about 10 microns, and applying thereover a cathodic electrophoretic coating at voltages of at least 300 V. The product of such method is corrosion resistant, free of craters or pores, and is readily welable prior to the application of said cathodic electrophoretic coating.

9 Claims, No Drawings

METHOD OF PRODUCING METAL-FILLED ORGANIC COATING

BACKGROUND OF THE INVENTION

The present invention relates to a coating method for the production of a corrosion-resistant sheet steel product having an outer metal-filled organic coating which does not cause cratering of cathodic electrocoat primers applied under conditions encountered in U.S. automotive electrocoating facilities.

Briefly, the coating technology to which the present invention relates is described in the literature under such terms as cathodic electrodeposition, cathodic electrophoretic coating, or e-coating. Such technology was developed in the mid-1970's and is now widely practiced in the automotive and applicance industries. The automotive industry, by way of example, adopted cathodic electrodeposition as a coating method for a number of reasons. Such reasons include the ability to obtain uniform coverage of the substrate, access to all parts of the substrate, increased corrosion protection, automation, and minimum environmental pollution, for instance. One of the disadvantages or conditions of coating through electrodeposition is that the substrate must be electrically conductive.

Although cathode electrocoat primers provide a degree of corrosion protection, paint on bare steel may not be sufficiently corrosion resistant for some applications. As a way to improve corrosion performance the steel industry turned to a zinc-rich paint system applied to only one side of a steel strip on a continuous coil coating paint line. A strong argument in support of the use of zinc pigment was the belief that such zinc would provide some galvanic protection to the underlying steel strip. In any case, a commercial product utilizing such a system is ZINCROMETAL. Such product is actually a dual coat system wherein the initial coat is a proprietary mixture of chromic acid, zinc dust and other chemicals, while the outer coating is an organic resin containing zinc powder. While ZINCROMETAL coatings appeared to satisfy the requirement for improved corrosion performance, such coating tended to show an inherent surface defect, common to all zinc coatings, when cathodic electroprimed at high voltages. By high voltages we mean voltages in excess of 250–300 volts, as typically used in the U.S. automotive industry. These surface defects had the appearance of craters or pinholes in the surface. Not only was this an appearance problem, it was also a corrosion problem. Needless to say, the subsequently applied outer coating, or cathodic electropaint, was not sufficient to mask the craters, nor to overcome the corrosion problem.

PROBLEMS WITH Zn-FILLED ORGANIC COATINGS

The cratering problem is a topic of world-wide interest as evidenced by the following articles.

1. "Problems Associated with the Electrophoretic Deposition of Paint on Galvanized Steel," by L. L. Franks et al, presented at ASM/ADDRG Conference in April 1981 at Dearborn, Mich., and
2. "Multilayer ElectroGalvanized (Zn-Cr-CrOX) Steel Sheet for Optimum Corrosion Protection of Car Bodies." by A. Catanzano et al, presented at SAE Int'l Conference in Feb.-March, 1983 at Detroit, Mich.

In the Franks et al article, cratering is attributed to hydrogen generation. The authors identify two factors with cratering, namely, deposition voltage and deposition current density. Catanzano et al offer an extensive discussion on 'Hydrogen Cratering'. However, rather than attempt to modify the operating conditions of the process, the latter authors propose a multilayer electrogalvanizing process. The result of such process is a coated product, allegedly resistant to cratering, which was given the name ZINCROX, a registered trademark of Zincroksid S.p.A.

The present invention is based on the dual discovery and/or recognition that cratering of metal-filled organic coatings is related to the chemical nature of the metal filler. From here it was possible to develop a method for providing a corrosion resistant coating offering barrier layer protection to steel equivalent to zinc-filled organic coatings, but which is not susceptible to cratering when coated with a cathodic electrophoretic primer at voltages in excess of 300 V. Such development, to be described in detail in the specifications which follow, can open the door to the use metal-filled organic coatings on the visible areas of an automobile.

SUMMARY OF THE INVENTION

This invention relates to a method of coating a ferrous substrate that includes the application of a cathodic electrophoretic primer coat. The method includes the steps of optionally placing a first coat, layer, or film on a ferrous substrate, such as sheet steel, where such optional coat, layer or film is sufficient to provide some corrosion protection to the underlying ferrous substrate. To said bare substrate, coat, layer or film, as the case may be, an outer coating of an organic resin containing a particulate metal selected from the group consisting of Al, Ni, Cr, Fe, Mn, Cu, Mo, Co, Ag, Au and alloys thereof. The particle size of said metal or alloy should be less than the thickness of such outer coating. A preferred size is no more than about 15 microns, with a more preferred size no greater than about 10 microns. This product is readily weldable, and when coated with a cathodic electrophoretic primer coat at voltages of at least about 300 V is substantially free of craters.

DETAILED DESCRIPTION OF PREFERRED EMBODIMENT

The present invention is directed to a method, of producing a corrosion-resistant coated ferrous product with an outer layer comprising a metal-filled organic coating with metal filler particles selected from the group consisting of Ni, Cr, Mn, Cu, Mo, Co, Ag, Au and alloys thereof. Such a coating provides an effective barrier to corrodents, allows resistance spot-welding and does not cause crater-like defects when coated with cathodic electrophoretic primers under conditions typically employed in the U.S. automobile industry. The method includes the steps of selecting a ferrous substrate, such as sheet steel preferably containing a first coating having certain corrosion resistant characteristics, and applying thereto an outer coating of an organic resin containing a particulate metal selected from such group. The particle size of said metal or alloy is preferably no more than about 10 microns. In this form the metal-filled organic coated product is subjected to a cathodic electrophoretic primer coat.

Cathodic electrophoretic coating or the cathodic electrodeposition process are described by M. Wismer et al in the *Journal of Coatings Technology, Vol.* 54, No.

688, May 1982, at pages 35–44. In such process the deposited film is applied to the cathode which is the substrate upon which a coating is desired. The reactions and mechanisms are defined by Wismer et al as follows:

"Cathode electrolytes are polymers with basic moiety in the form of primary, secondary, or tertiary amines, or quaternary ammonium, sulfonium, or phosphonium groups, neutralized with organic or inorganic acids. They form positively charged resin micelles in aqueous media.

When such a polymer is dispersed in water and supplied with conductive electrodes and direct current, the following physical processes and chemical reactions occur.

Electrophoresis: The positively charged particles or micelles, under the influence of the electric field, migrate to the cathode:

CATHODIC REACTIONS:

Electrolysis of water $-2H_2O+2e^- \rightarrow H_2\uparrow+2OH^-$

Film deposition $-NR_2H^+ + OH^- \rightarrow NR_2\downarrow + H_2O$

ANODE REACTIONS: (Assume inert anode)

Electrolysis of water $2H_2O \cdot\cdot 4H^+ + O_2\uparrow + 4e^-$

Electroosmosis: The deposited film is adherent and develops a high resistance. The high voltage gradient across the film produces a phenomenon known as electroosmosis in which water and anions migrate towards the anode and are squeezed out of the film. This results in a very concentrated deposit, normally less than 10% water."

As shown by the above cathodic reactions, hydrogen is given off at the cathode. Presumably this is the basis for the widely held hydrogen evolution theory as the cause of cratering.

During the development of the present invention, a different theory evolved as the cause of cratering. Studies during such development have shown that susceptibility to e-coat cratering is an inherent property of certain metals (esp. Zn, Mg, Pb) and that e-coat cratering is caused by the following sequence of events:

1. Electrical discharges occur through the e-coat film during deposition.
2. Localized heating at the discharge sites causes premature, localized curing of the paint film while still in the paint bath.
3. During paint-cure baking, paint in the prematurely cured areas does not flow to fill voids—resulting in craters in the fully cured paint film.

This new theory resulted in the discovery that other powdered metals and alloys, excluding zinc, magnesium and lead powder, was the answer to permitting cathodic electrophoretic coating at high voltages without cratering. This fact will become clearer in the description hereinafter.

Table I sets forth the approximate maximum voltages (Vm), at which a crater-free cathodic electrophoretic coating can be deposited on various substrates. Insofar as the automotive industry is concerned, a minimum of about 300 V is necessary for the coating process to be acceptable for production purposes. In any event, for the purposes of this comparative study, all pre-coated substrates were coated with an organic coating produced by PPG Industries, Inc. under the designation ED3002 cathodic electrocoat bath. The designated metal powder in the coating of the substrate was approximately 60 Vol.%.

TABLE I

| Test | Substrate | Vm |
|---|---|---|
| 1 | Steel | 400–425 V |
| 2 | Zn powder-filled organic coating on steel | 225–250 V |
| 3 | 55% Al powder + 45% Zn powder-filled organic coating on steel | 225–250 V |
| 4 | 90% Al powder + 10% Zn powder-filled organic coating on steel | 275–300 V |
| 5 | Al powder-filled organic coating on steel | 375–400 V |
| 6 | Ni powder-filled organic coating on steel | 325–350 V |
| 7 | Mg powder-filled organic coating on steel | 225 V |

NOTE: powder mix is by weight %.

As expected, the bare steel was readily coated, without the formation of craters, at voltages well in excess of 300 V. However, of the six (6) pre-coated substrates, only the coatings free of Zn and Mg remained crater-free when coated at voltages in excess of 300 V.

A preferred product of this invention is one which includes the steps of applying a first corrosion inhibiting layer to the steel base prior to the application of the coating of this invention. An example of such a first coating is the coating described in U.S. Pat. No. 3,687,738, to Malkin, and directed to a coating of $CrO_3$ and pulverulent metal, such as zinc dust, in a liquid medium. After suitable drying and curing of the coating, the thus coated steel base is ready for the coating of this invention. While zinc is susceptable to cratering, the overlayer isolates such zinc from the cathodic electrophoretic coating. Accordingly, such first coating will not result in such cratering.

The coating of this invention may be applied to the bare steel, or precoated steel, as the case may be, by any conventional method for applying a liquid coating to a substrate, for example, dip coating, roller coating, spray or brush coating, etc. By any of such methods, the coating thickness should be in the range of about 0.5 to 1.0 mil, preferably no more than about 0.75 mils. However, before applying the e-coat, the organic metal-filled coating must be cured. A typical curing treatment is one which includes heating the invention coated product to a peak metal temperature of 550° F., followed by water quenching and air drying of the product.

The above product, insofar as the automotive industry is concerned, is an intermediate product. However, it is a product to which an e-coat is applied, at voltages in excess of 300 V, without the susceptability for cratering.

To further demonstrate the effectiveness of this invention, and to provide an exemplary teaching of the practice thereof, the following is presented.

1. A low-carbon steel sheet was selected and suitably cleaned by an alkaline cleanser to remove grease and oxides which may be present on the sheet surface.
2. To such cleaned steel sheet, an adhesion promoting, corrosion-resistant base coat was applied.
3. A slurry of an organic coating was prepared, the formulation of which is as follows:

| | Ingredients | lbs/100 gal. |
|---|---|---|
| a. | BAKELITE Phenoxy Resin PKHH (solid) | 123 |
| b. | MPA-60/xylene | 6.5 |
| c. | CELLOSOLVE Acetate | 432.5 |
| d. | Toluene | 86.7 |
| e. | LINDE Molecular Sieve 4A | 10.7 |

-continued

| | Ingredients | lbs/100 gal. |
|---|---|---|
| f. | Al powder (particle size < 10 μm) | 462 |

Note:
a, c, e - manufactured by Union Carbide.
b - a dispersant, anti-setting agent manufactured by Baker Castor Oil Co.

4. The organic coating was applied to the surface of such steel sheet to yield a dry coating thickness of about 0.8 mils.
5. The coated product of (4) was then heated to a steel sheet temperature of 550° F., water quenched and air dried.
6. A bath of a primer paint*, at a temperature of about 80° F. was placed in a receptacle for application to a prepared substrate (product of 4).

*PPG Industries Cathodic Electrocoat Bath ED3002-Non-volatile solids content = 20.9%, pH = 6.2 – Conductivity = 1300 micromhos 7. The product of (5), as the cathode, and a stainless steel anode were inserted into such primer bath, and a voltage of 300 V applied therebetween for two (2) minutes.
8. The primer coated cathode, i.e. sheet steel, was removed, rinsed in water, and baked for twenty (20) minutes at 360° F.

A careful inspection of the primer painted sheet steel, processed in accordance with the teachings of this invention, revealed a smooth, crater-free surface.

We claim:

1. In a method of electrophoretically coating a weldable composite ferrous substrate which includes the steps of selecting a ferrous substrate whose surface has been suitably cleaned of grease and oxides, applying to such surface an organic coating having dispersed therein a particulate metal, which coating has been applied to a depth of between about 0.5 to 1.0 mil, and curing such metal-filled organic coating through heating and quenching, the improvement comprising in combination therewith the steps of selecting said particulate metal from the group consisting of Al, Ni, Cr, Fe, Mn, Cu, Mo, Co, Ag, Au and alloys thereof and subjecting the thus coated product to cathodic electrophoretic coating at an applied voltage of at least 300 V.

2. The method according to claim 1 characterized in that said ferrous substrate has been provided with an initial layer possessing corrosion inhibiting properties, prior to the application of such metal-filled organic coating.

3. The method according to claim 2 characterized the ferrous substrate has been subjected to fabrication and welding after said curing step.

4. The method according to claim 1 characterized in that the particle size of said particulate metal is no more than about 15 microns.

5. The method according to claim 4 characterized in that said ferrous substrate has been provided with an initial layer possessing corrosion inhibiting properties, prior to the application of such metal-filled organic coating.

6. The method according to claim 5 characterized in that the ferrous substrate has been subjected to fabrication and welding after said curing step.

7. The method according to claim 4 characterized in that the particle size of said particulate metal is no more than about 10 microns.

8. The method according to claim 7 characterized said ferrous substrate has been provided with an initial layer possessing corrosion inhibiting properties, prior to the application of such metal-filled organic coating.

9. The method according to claim 8 wherein the ferrous substrate has been subjected to fabrication and welding after said curing step.

* * * * *